US007245312B2

(12) United States Patent
Smolenski et al.

(10) Patent No.: US 7,245,312 B2
(45) Date of Patent: Jul. 17, 2007

(54) THERMAL PRINTER WITH QUICK-RELEASE PRINTHEAD ASSEMBLY

(75) Inventors: Lawrence Edward Smolenski, Newbury Park, CA (US); Philip Alan Mastinick, Camarillo, CA (US)

(73) Assignee: ZIH Corp., Hamilton (BM)

( * ) Notice: Subject to any disclaimer, the term of this patent is extended or adjusted under 35 U.S.C. 154(b) by 210 days.

(21) Appl. No.: 11/149,667

(22) Filed: Jun. 10, 2005

(65) Prior Publication Data

US 2006/0279625 A1 Dec. 14, 2006

(51) Int. Cl.
*B41J 25/304* (2006.01)
*B41J 25/34* (2006.01)

(52) U.S. Cl. ..... 347/197; 400/120.16

(58) Field of Classification Search ..... 347/197, 347/198; 400/120.16, 120.17
See application file for complete search history.

(56) References Cited

U.S. PATENT DOCUMENTS

| | | | | |
|---|---|---|---|---|
| 3,960,255 | A * | 6/1976 | Bisson et al. | 400/120.16 |
| 5,455,617 | A * | 10/1995 | Stephenson et al. | 347/214 |
| 5,528,277 | A | 6/1996 | Nardone et al. | |
| 6,068,415 | A | 5/2000 | Smolenski | |
| 6,068,420 | A | 5/2000 | Austin et al. | |
| 2005/0276645 | A1 * | 12/2005 | Hirte et al. | 400/59 |

* cited by examiner

*Primary Examiner*—Huan Tran
(74) *Attorney, Agent, or Firm*—Alston & Bird LLP

(57) ABSTRACT

A quick-release printhead mounting assembly and thermal printer incorporating same, including a printing component, a printer housing, and, a component retention feature attached to or molded into the printer housing adapted for receiving and releasably fixing the printing component to the housing. The retention feature holds the printhead in a fixed position relative to the housing and, therefore, also relative to the platen of the printer. The printing component is advantageously a printhead, such as a thermal printhead, or the combination of a thermal printhead and a heat sink.

30 Claims, 9 Drawing Sheets

THERMAL PRINTER WITH QUICK-RELEASE PRINTHEAD ASSEMBLY

BACKGROUND OF THE INVENTION

1. Field of the Invention

The present invention relates to printhead assemblies for use in thermal printers. More particularly, the invention relates to the assembly or attachment of thermal printheads within thermal printer housings.

2. Description of Related Art

Thermal printers require that a thermal printhead be oriented and maintained in close proximity to print media during printing so that the printhead may heat a thermal transfer ribbon to cause coloration to be transferred to the print media or, alternatively, to directly heat regions of thermal contact media, thereby causing the contact media to change color. The printheads are typically joined with heat sinks to provide for heat dissipation, and the joined parts are typically positioned within a printer housing such that a print media may be moved within the housing relative to the printhead. Alternatively, the printhead may be movable within the housing with respect to the print media, or both printhead and media may be movable.

The printhead may be fastened within the printer housing in a number of ways. For instance, the printhead may be integrated with mechanical or electronic components within the housing, or the printhead may be fastened to a subframe within the printer housing. Most typically, the printhead is affixed to the printer housing using one or more brackets. For instance, in clamshell-type printer housings (i.e. housings having a base portion and lid portion that are hingably connected to one another), the printhead is affixed by brackets to the lid of the housing and a platen is affixed to the base of the housing such that the printhead and platen are positioned adjacent to one another when the housing is closed. This arrangement is advantageous because the region between the printhead and platen may be easily accessed by opening the housing, facilitating removal of print media or other printer maintenance.

Direct attachment of the printhead to electronic or mechanical components is often problematic due to added process steps required to attach or replace the printhead. Similarly, the use of traditional brackets to attach a printhead to the housing or sub-frame of a printer is problematic because of added complexity and production and assembly costs associated with fixing a printhead within the brackets. Further, replacement of a printhead typically involves removal of screws, brackets, or other hardware used to hold the printhead in place, thereby making it difficult for an end user to replace a printhead.

It would therefore be advantageous to have an improved printhead assembly that would allow the printhead to be more easily installed and replaced within a thermal printer. It would be further advantageous if the improved assembly reduced time and cost associated with installation of the printhead.

SUMMARY OF THE INVENTION

The invented quick-release printhead assembly allows for the convenient installation or replacement of a printing component, e.g. a thermal printhead or combination of thermal printhead and heat sink, within a thermal printer by providing a push-lock retention feature fixed within the housing of a printer body and providing a printing component that is correspondingly sized and shaped to be releasably received into the retention feature. The retention feature holds the printhead in a fixed position relative to the housing and, therefore, also relative to the platen of the printer during operation of the printer.

The retention feature is preferably molded directly into a portion of the printer housing, thereby eliminating the need to produce or use attachment brackets or other hardware to affix the printing component within the printer. Alternatively, the retention feature may comprise one or more brackets or similar hardware mounted to the printer housing.

According to one embodiment, the invented printhead assembly comprises a thermal printer housing, a push-lock retention feature attached to or integrally molded as part of the housing, and a printing component adapted to be received and retained by the retention feature.

According to another embodiment, the printing component may be more precisely positioned adjacent to the platen and associated print media of the printer by incorporating a biasing member within the printer such that the biasing member contacts the printing component upon fixing the printing component in the retention feature so that bias is maintained on the printing component when installed in the retention feature.

According to another embodiment, the retention feature comprises two opposing mounting elements within the housing, and the printing component has two opposing end regions that correspond to the respective mounting elements of the retention feature. At least one of the mounting elements has a push-lock mechanism, and the printing component may be inserted into the retention feature simply by pushing the component into place. Conversely, the printing component may be removed by deflecting a release feature of the push-lock mounting element, thereby releasing the printing component from the retention feature.

According to a more particular embodiment, the printhead is an elongate member having two opposing ends, the heat sink is an elongate member having two opposing ends, and the printhead and heat sink are bonded to form an elongate printing component wherein the corresponding ends of the printhead and heat sink are adjacent one another. The length of the elongate members is advantageously greater than the width of the print media to be printed, and the ends of the heat sink are adapted for retention in the retention feature.

According to another embodiment, the invention encompasses a thermal printer with a readily-replaceable printing component and method of installing the printing component, the printer having a printer housing with a component retention feature attached to or integrally molded therein, a platen that mates with the housing, and a printing component, wherein the printing component is releasably fixed within the retention feature of the housing. The thermal printer may comprise any combination of the advantageous features discussed with regard to the printing component, including a biasing member for biasing the printhead toward the platen. In addition, the thermal printer may include components that improve upon the general performance of the printer, including a microprocessor in electronic communication with the printhead, an electromotive device in mechanical communication with the platen, a media receptacle within the housing for holding a supply of print media, and further including additional features generally known in the art of thermal printers.

The quick-release printhead assembly design provides several advantages over printhead assemblies of the past. By use of a push-lock feature, such as a deflecting lock tab, the printhead or combined printing component is easily installed within the retention feature without the need for tools. By incorporating a release feature into the retention feature, the printing component may be conveniently, easily, and quickly removed or replaced. The optional biasing member automatically provides a biasing force against the installed printing component, thereby providing optimal placement of the printhead without the need to adjust brackets or other hardware. These and other advantages will be evident to one of skill in the art after review of this disclosure.

BRIEF DESCRIPTION OF THE SEVERAL VIEWS OF THE DRAWINGS

Figure 1:
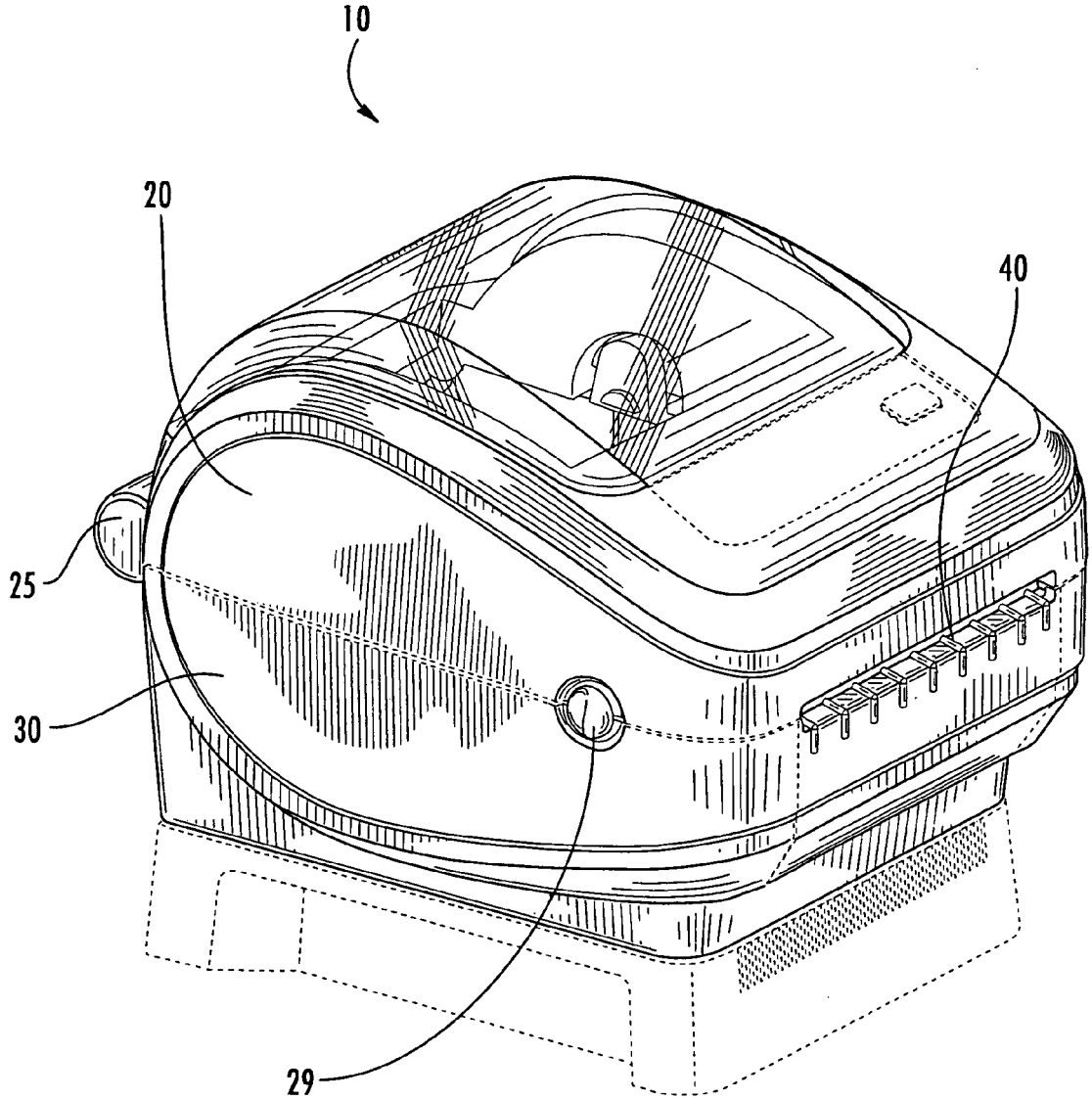
Figure 2:
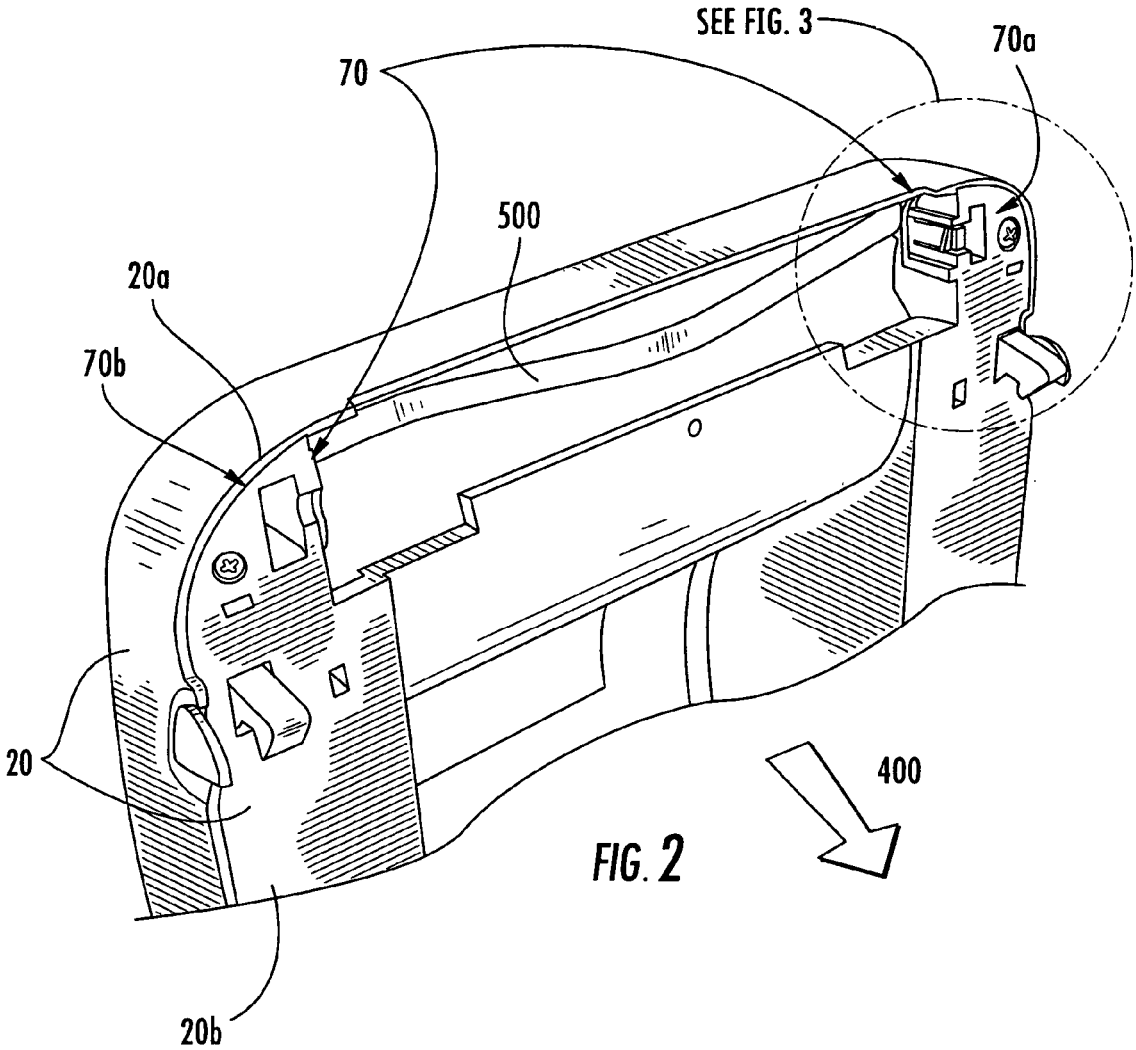
Figure 3:
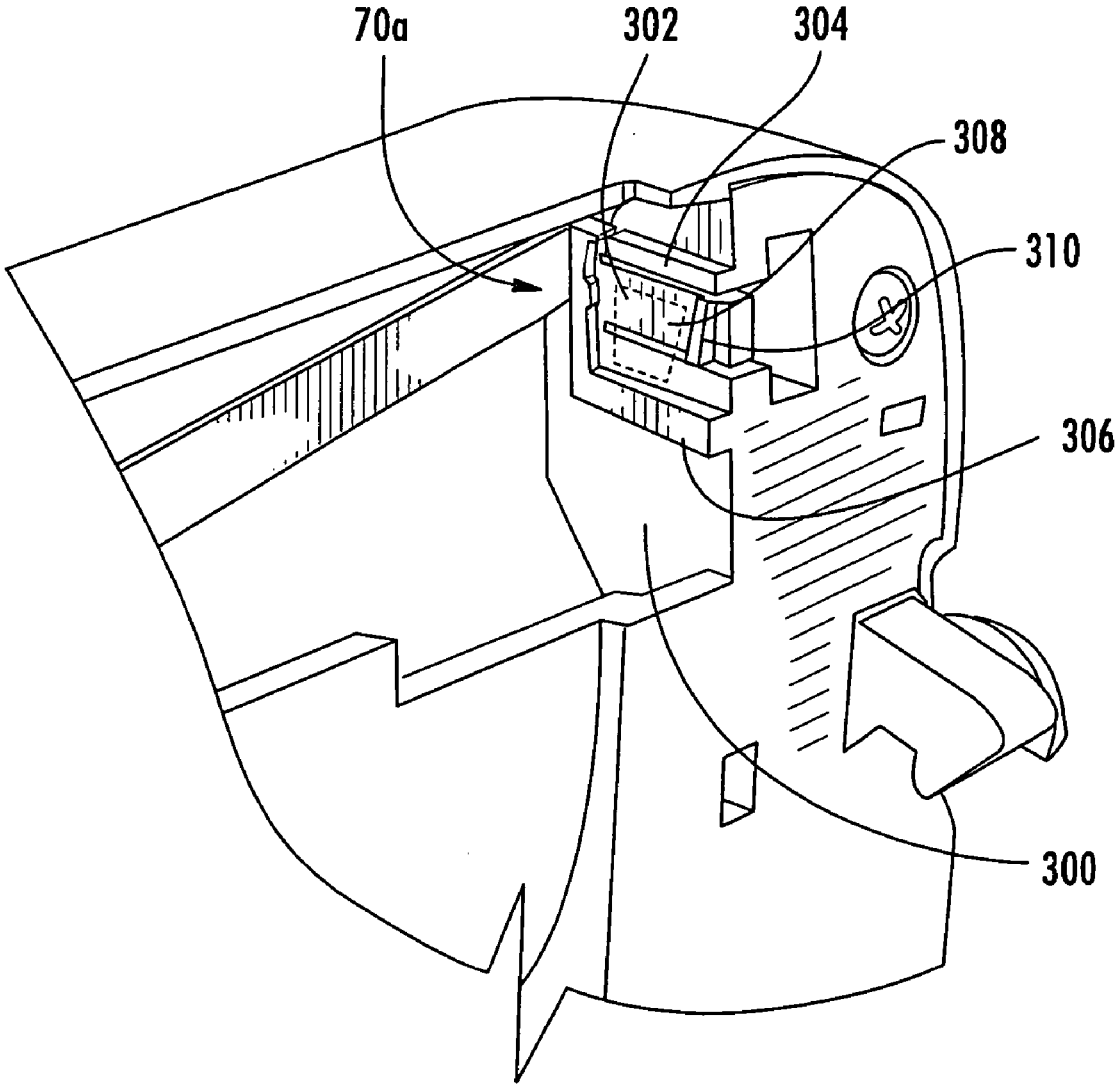
Figure 4:
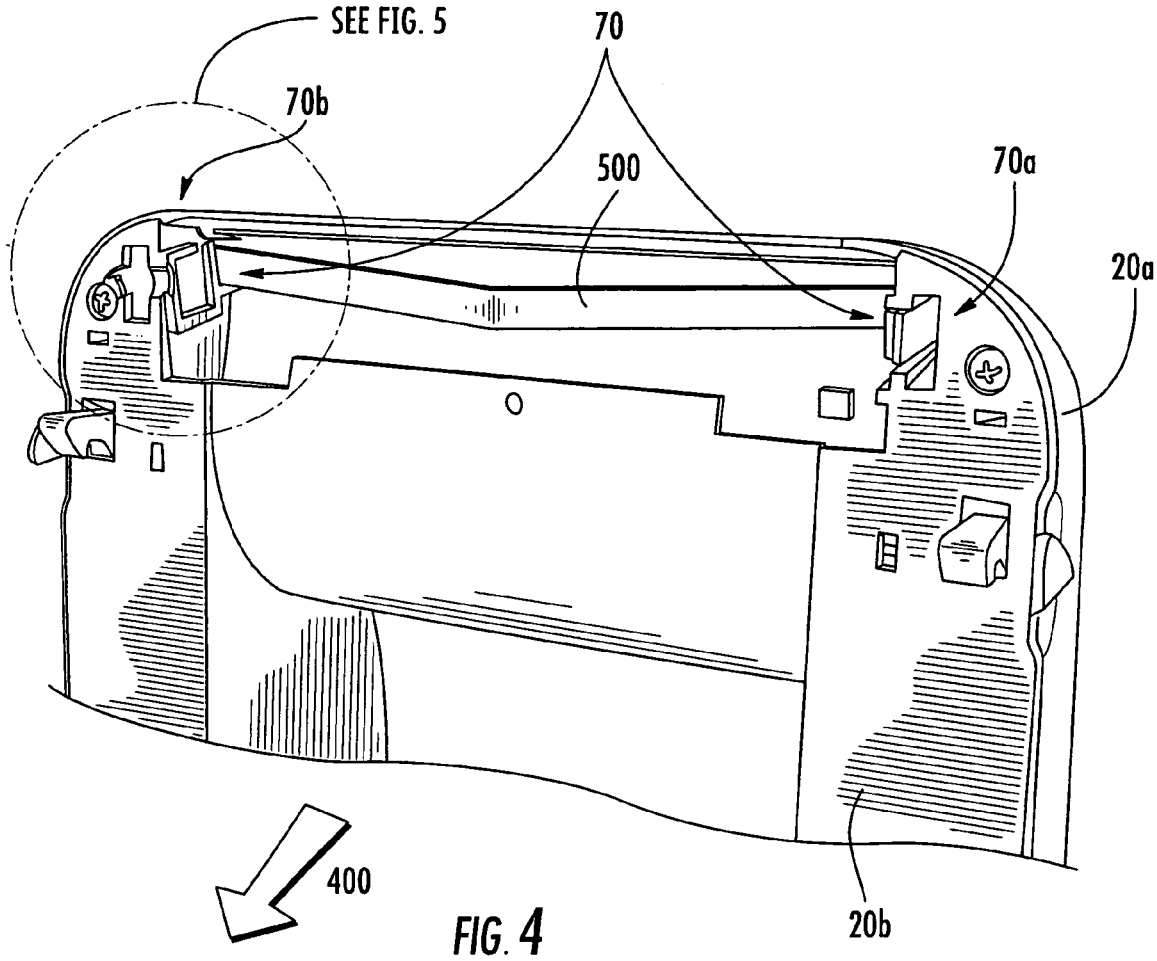
Figure 5:
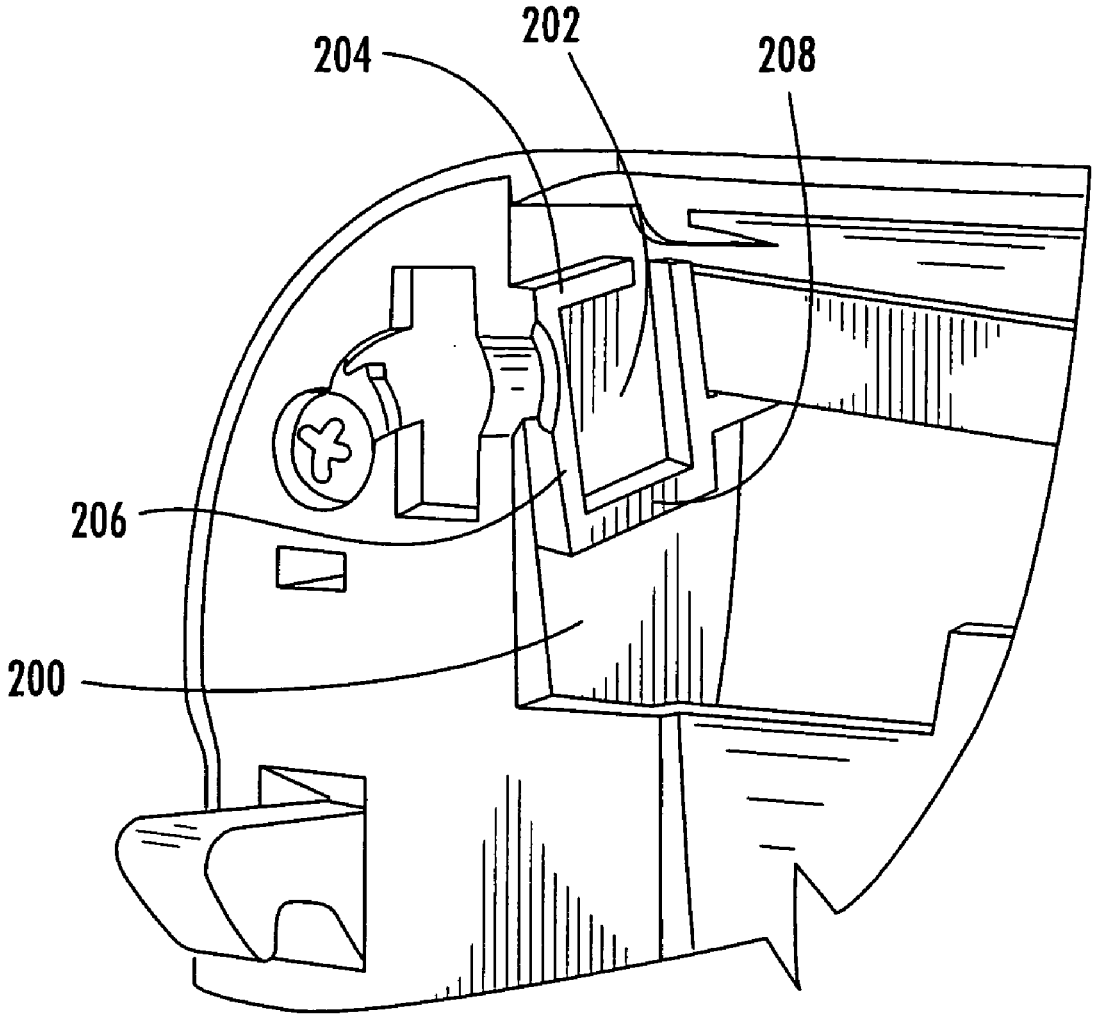
Figure 6:
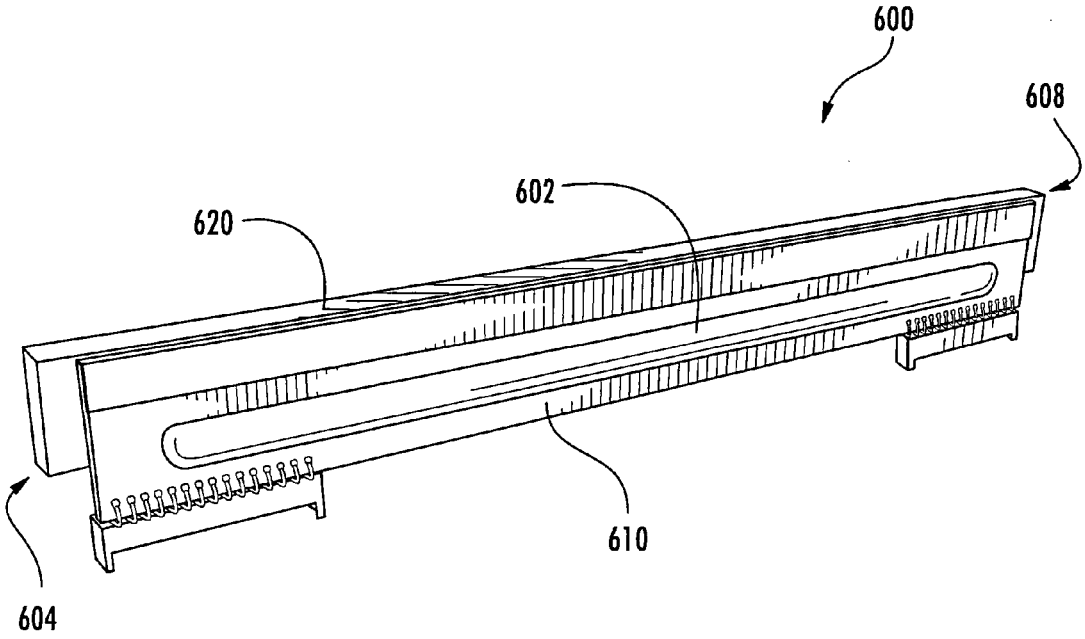
Figure 7:
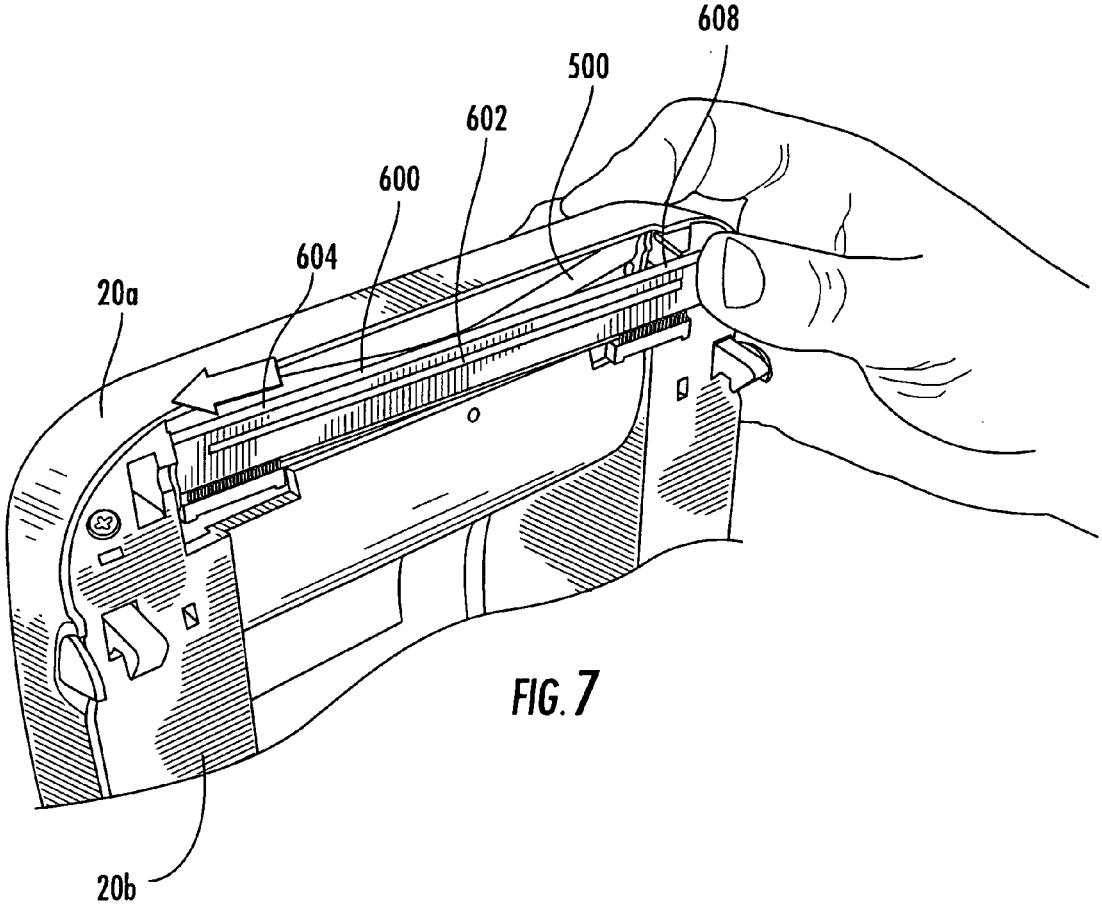
Figure 8:
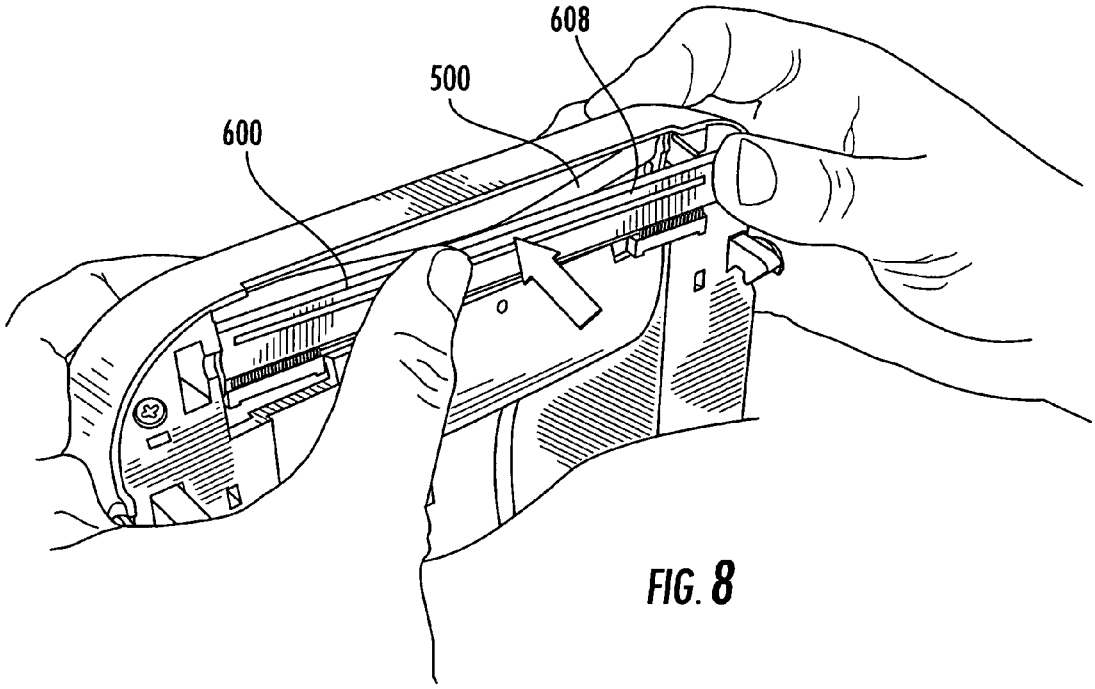
Figure 9:
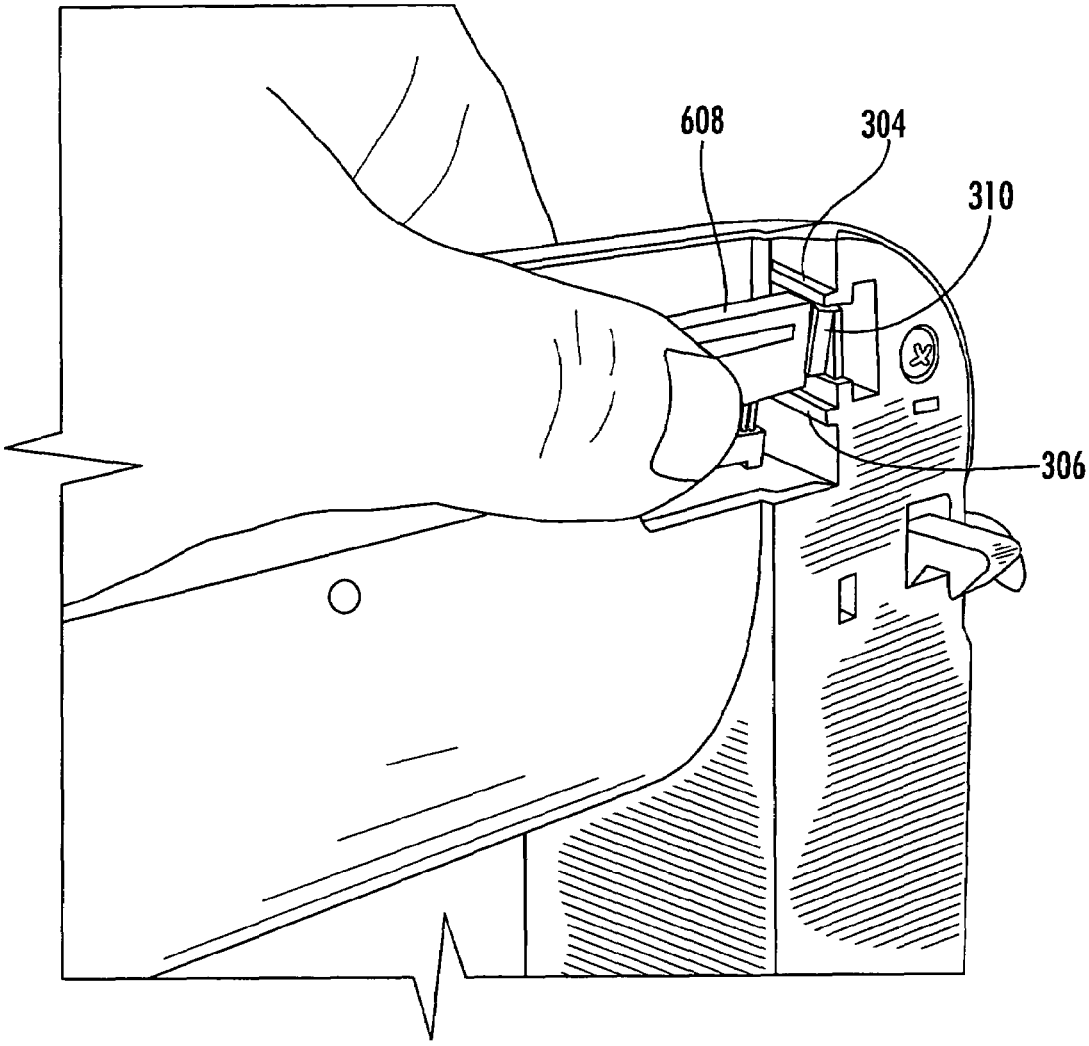

Having thus described the invention in general terms, reference will now be made to the accompanying drawings, which are not necessarily drawn to scale, and wherein:

FIG. 1 is a perspective view of the outer housing of a printer of one embodiment of the present invention;

FIG. 2 is a perspective view of a portion of a printer housing having a component retention feature according to an embodiment of the present invention;

FIG. 3 is a blown up perspective view of a mounting element of the printer housing of FIG. 2;

FIG. 4 is another perspective view of the portion of a printer housing having a component retention feature according to the embodiment of FIG. 2;

FIG. 5 is a blown up perspective view of a mounting element of the printer housing of FIG. 4;

FIG. 6 is a perspective view of a printing component in accordance with an embodiment of the invention; and, FIGS. 7, 8, and 9 are perspective views a portion of a printer housing having a component retention feature and a corresponding printing component, wherein the insertion of a printing component into the retention feature is illustrated in accordance with an embodiment of the invention.

DETAILED DESCRIPTION OF THE INVENTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

FIGS. 1–9 are directed to an exemplary embodiment of the invented printhead assembly and to an exemplary thermal printer that incorporates the assembly. The exemplary embodiment and further embodiments are described herein without detailed description of well-known structures associated with thermal printers, such as drive mechanisms, print media, print media handlers, and electronic or microprocessor controllers, as the operation of structures within the printer are readily understood by those of skill in the art and reiteration herein is not necessary to understand the invention.

The invention is described in the context of and with reference to a printer housing. As used herein, the term "housing" broadly refers to an article, typically molded, that comprises or is integral with the walls of the printer enclosure and forms the predominent portion of a printer body. The description will further make reference to the "inner wall" of the housing. The inner wall of the housing is typically contoured to make space for internal printer components and to facilitate attachment of components such as frames or sub-frames, while an outer wall generally defines the outer shape of the printer.

The disclosure also refers to a printing component. As used in the context of thermal printing, the term "printing component" refers to a thermal printhead or, alternatively, to the combination of a thermal printhead integrally bonded to a heat sink. According to another embodiment, the printing component includes a printhead and heat sink, including wiring and associated wiring harnesses, but excluding components which primarily perform functions distinct from the printhead and heat sink within the printer. The printhead is typically an elongate member having an array of separately energizable thermal heating elements running along a printline, wherein the printline runs about the length of the elongate member. The printline is typically slightly longer than the width of the print media for which the thermal printer is designed.

Referring to FIG. 1, the outer housing of the exemplary thermal printer 10 is shown. In the illustrated embodiment, the housing comprises two main sections, an upper housing section 20 and lower housing section 30 that are hinged by a housing hinge 25. When in the closed position, the upper section 20 and lower section 30 mate along a seam 27 to enclose a volume containing elements of the thermal printer. The sections 20, 30 are latched together by one or more latching mechanisms 29 that may be actuated and released manually. The housing has openings or apertures for power and data cables (not shown) and a slot-shaped print media port 40 for release of printed media.

Referring to FIGS. 2 and 4, a component retention feature 70 is shown. The retention feature 70 is located within the upper housing section 20 of the housing. The upper section 20 is comprised of an outer wall 20*a* and an inner wall 20*b* wherein the outer 20*a* and inner 20*b* walls may be a unitary, integrally molded unit or may be discretely molded parts that are fastened together to form the upper section 20.

For ease of description, the term "inward" is used to describe the direction indicated by arrow 400, which is generally the direction projecting away from the face of the inner wall 20*b*. The orientation of some elements is described with respect to the print line of the printhead. In the event no printhead is actually installed, those descriptions relate to the location and orientation the printhead would have if installed within in the retention feature.

According to this embodiment, the retention feature 70 is integrally molded into the inner wall 20*b*. Alternatively, the retention feature 70 could comprise a bracket or other hardware mounted to the inner wall 20*b*. The retention feature 70 comprises two opposing mounting elements 70*a*, 70*b*, advantageously located on opposite sides of the media path. Referring to FIG. 3, where the first mounting element 70*a* has a planar wall 300, a retention region 302 of the wall 300 is defined by raised ridges 304, 306 that extend in the direction of the opposing mounting element 70*b*. The raised ridges 304, 306 are oriented parallel to one another, perpendicular to the print line of the printhead, and perpendicular to the face of the inner wall 20*b*. A push-lock feature 308 is defined within the planar wall 300 between the raised ridges 304, 306. The push-lock feature 308 is generally coplanar with the planar wall 300 but has a lip 310 projecting toward the opposing mounting element 70*b* that bounds the retention region 302 in the inward direction. The push-lock feature 308 is molded in such a shape to allow for deflection of the feature 308 away from the printhead.

Referring to FIG. 5, the second mounting element 70*b* is a molded element having a planar wall 200. A first region 202 of the wall 200 is defined by raised ridges 204, 206, 208 that extend from the wall 200 in the direction of the opposing mounting element 70*a*. The raised ridges protrude from the planar wall 200 such that the first region 202 is bounded inwardly by a forward ridge 206 and ridges 204, 208 oriented perpendicular to the forward ridge 206.

Referring back to FIGS. 2 and 4, a biasing member 500 is advantageously positioned on or within the upper housing section 20 such that a bias force is directed upon a printing component when installed in the retention feature 70. An exemplary biasing member 500 is a flexible, angled, elongate strip of metal having ends attached at or near the respective mounting elements 70*a*, 70*b* and a midsection that is angled inwardly to occupy at least a portion of the space normally occupied by the printing component when installed. Operation of the biasing member 500 is described in more detail below.

Referring to FIG. 6, most embodiments of the invention contemplate that the printing component 600 is an elongate member having ends 604,608, wherein the ends are used to secure the printing component 600 within a retention feature of the housing. The printing component 600 contemplated in the following exemplary embodiment comprises an elongate thermal printhead 610 having a printline 602, i.e. a linear array of thermal print elements. The printhead 610 is disposed upon an elongate heat sink 620 such that the respective ends of the components 610,620 are adjacent one another, but where the heat sink 620 is slightly longer than the printhead 610 such that the ends of the heat sink protrude slightly beyond the respective ends of the printhead. In such an arrangement, as illustrated in FIGS. 7, 8, and 9, the ends of the heat sink may be disposed within the retention feature in order to secure the printing component within the printer.

Referring to FIGS. 7, 8, and 9, the printing component 600 is retained within the retention feature 70 by securing respective ends of the printing component 600 within the mounting elements 70*a*, 70*b*. The ends 604, 608 of the printing component 600 correspond to the shape of the respective retention regions 202, 302, and the distance between the ends 604, 608 of the printing component 600 is approximately equal to the distance between the opposing planar walls 200, 300 of the mounting elements 70*a*, 70*b*.

The printing component 600 is installed in the retention feature 70 by placing a first end 604 of the elongate printing component 600 within the second mounting element 70*b* with the print line 602 of the component 600 facing inward 400. The end 604 is installed such that the end 604 abuts the retention region 202 of the mounting element 70*b*, and such that the end 604 is prevented from inward 400 movement by the forward ridge 206 mounting element 70*b*.

Referring to FIGS. 8 and 9, while maintaining the first end 604 of the printing component 600 against the retention region 202 of the second mounting element 70*b*, the second end 608 of the printing component 600 is pressed into the first mounting element 70*a* such that the second end 608 slides between the raised ridges 304, 306 and over the lip 310 of the push-lock feature 308. The push-lock feature 308 is deflected outwardly from the printing component 600, either manually or by insertion of the assembly over the angled lip 310, to allow the end 608 of the component to pass over the lip 310. Once the end 608 is inserted, the push-lock feature 308 returns to its original position such that the lip 310 prevents the end 608 from moving inward past the lip 310.

Upon insertion of the printing component 600, the printing component contacts and compresses the biasing member 500 such that the biasing member 500 provides a biasing force upon the printing component 600 in the inward direction 400. The biasing force acts to maintain the printing component firmly against ridge 206 and lip 310. Thus, the biasing member maintains the printhead in close proximity to the print media during use of the printer. Advantageously, the biasing member allows for movement of the printing component 600 in response to increased pressure upon the print line 602 surface of the printhead, such as during use of relatively thick print media or transfer of creased media between the printhead 610 and the platen of the printer, while maintaining the printing component 600 in firm biased engagement with the print media.

Referring again to FIG. 1, it is recognized that once the printer 10 is closed, i.e. housing members 20 and 30 are engaged with one another, the printing component 600 will correspond to and contact or be in close proximity with a cylindrical platen (not shown) such that the printline of the printhead is aligned with the axis of the cylindrical platen. Operation of the printer causes print media to travel between the printing component 600 and the platen as the media exits the print media port 40.

The contemplated printer is understood to contain components and to function as thermal printers known in the art except for the form and function of the invented printhead assembly. According to an exemplary embodiment of the thermal printer, the printer may contains a main circuit board including a processor and other electronic components for controlling printer operation which are not described in greater detail herein for the sake of brevity. The main circuit board is in communication with a drive assembly, the printhead assembly, and may also be in communication with a display unit, user input panel, and/or an electronic input device such as a cash register or personal computer.

The drive assembly includes a motor and drive gears for advancing print media. The drive gears are connected to a platen assembly that advances print media within the printer by friction feed. Typical platen assemblies include a platen bar, a platen shaft, and a platen gear supported by a platen frame. An exemplary platen bar is an elongate, cylindrical bar that includes a rubber or polymeric coating to facilitate gripping of the strip of media.

Though the retention feature of the illustrated exemplary embodiment is adapted to accept the ends of an elongate printing component, it is noted that the mounting elements of the retention feature could be positioned at any number of locations with respect to the printing component, including the middle of the component or offset along the side edges of the component, and such embodiments are likewise taught by this disclosure. In addition, any or all of the mounting elements could comprise a push-lock feature.

The mounting elements of the exemplary embodiment are described as planar faces having raised ridges which act to retain ends of a printing component. It is recognized that mounting elements may be any shape that is similarly suitable for retention of a printing component. For example, the profiles of the mounting elements and corresponding ends of the printing components may be selected from various profiles such that the ends may be retained in the elements.

The quick-release printhead assembly utilizes one or more push-lock features such as shown above as item 308. In general, push-lock features advantageously comprise at least one element that is deflectable upon insertion of a printing component such that the printing component may be installed over or around the feature, or between deflectable elements if multiple deflecting elements are used, by application of force upon the printing component and/or the push-lock feature. After installation, the deflecting element returns to its original position such that the printing component is retained by the feature. For removal of the printing component, the deflecting element of the push-lock feature is deflected, either by force exerted on the printing component or the push-lock feature itself, allowing the printing component to be removed.

The retention feature may be comprised of one or more adaptors that are affixed to the printer housing. Such adaptors may be installed by the manufacturer or by an end user. Each adaptor comprises a first portion attachable to the printer housing and a second portion forming all or part of a retention feature. For instance, thermal printers having standard printhead mounting brackets may be retrofitted and converted to thermal printers of the invention by fastening such adaptors to the standard mounting brackets and thereafter installing printing components within the adaptors rather than the brackets.

Printing component adaptors could be attached to printing components and used to conform printing components to the size and shape needed to fit in retention features for which they were not originally designed.

As mentioned, the invented printhead assembly and printers incorporating the assembly provide numerous advantages over assemblies and printers of the prior art. The use of the release feature in the retention features enables printing components to be easily installed, removed, and replaced without the need for tools or other equipment.

Correspondence of the mounting elements and the shape and size of the printing component ensures proper orientation of the printhead upon insertion without the need for further adjustments. Use of the biasing member in conjunction with the retention feature allows for favorable movement of the printhead with variation in print media thickness while favorably maintaining the printhead against the print media during operation of the printer. Further, use of the biasing member provides constant pressure upon the printing component such that the printing component is favorably ejected from the retention feature upon actuation of the release feature. Thus, the invented printhead assembly and associated thermal printer exhibit a multitude of advantages not found in previous printers.

Many modifications and other embodiments of the inventions set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A quick-release printhead assembly for a thermal printer comprising:

a printing component;

a molded printer housing, having a push-lock retention feature adapted for receiving and releaseably fixing the printing component within the housing.

2. A printhead assembly of claim 1, wherein the printing component comprises a thermal printhead integrally joined to a heat sink.

3. A printhead assembly of claim 2, wherein the printhead is an elongate member having two opposing ends, the heat sink is an elongate member having opposing ends, and the printhead and heat sink are joined to form an elongate printing component wherein the corresponding ends of the printhead and heat sink are adjacent one another.

4. A printhead assembly of claim 1, further comprising at least one biasing member positioned within said housing positioned adjacent to said retention feature such that the biasing member contacts the printing component upon installing the printing component in the retention feature.

5. A printhead assembly of claim 1, wherein the retention feature comprises two opposing mounting elements molded within the housing, and wherein the printing component has two opposing end regions that correspond to the respective mounting elements of the retention feature.

6. A printhead assembly of claim 5, wherein at least one of the mounting elements has a release feature that allows for release of the printing component from the housing upon deflection of the release feature.

7. A printhead assembly of claim 5, wherein at least one of the mounting elements comprises a generally planar surface having ridges protruding therefrom, wherein the area of the planar surface defined by the ridges corresponds to at least one end of the printing component.

8. A printer having a readily-replaceable printing component, comprising:

a molded printer housing having a push-lock retention feature integrally molded therein;

a printing component releasably fixed within the retention feature of the housing; and, a platen maintained within the molded housing wherein the printing component and platen are positioned in a mating relationship.

9. A printer of claim 8, wherein the printing component is a thermal printhead integrally joined to a heat sink.

10. A printer of claim 8, further comprising at least one biasing member in said housing positioned adjacent to said retention feature such that the biasing member contacts the printing component upon fixing the printing component in the retention feature.

11. A printer of claim 8, wherein the retention feature comprises two opposing mounting elements within the housing, and wherein the printing component has two opposing end regions that correspond to the respective mounting elements of the retention feature.

12. A printer of claim 11, wherein at least one of the mounting elements has an integrally molded release feature that allows for release of the printing component from the housing upon deflection of the release feature.

13. A printer of claim 9, wherein the printhead is an elongate member having two opposing ends, the heat sink is an elongate member having opposing ends, and the printhead and heat sink are joined to form an elongate printing component wherein the corresponding ends of the printhead and heat sink are adjacent one another.

14. A printer of claim 8, further comprising a microprocessor in electronic communication with the printhead.

15. A printer of claim 14, further comprising an electromotive device positioned within the housing in mechanical communication with the platen.

16. A printer of claim 15, further comprising a media receptacle within the housing for holding a supply of print media.

17. A thermal printer having a quick-release printhead assembly, comprising:

a molded printer housing having two opposing mounting elements integrally molded therein; and a printing component comprising a thermal printhead integrally joined to a heat sink wherein the printhead is an elongate member having two opposing ends, the heat sink is an elongate member having opposing ends, and the printhead and heat sink are joined to form an elongate printing component wherein the corresponding ends of the printhead and heat sink are adjacent one another and wherein the ends of the heat sink are releasably fixed within the respective opposing mounting elements.

18. A thermal printer of claim 17, further comprising at least one biasing member in said housing positioned with respect to said mounting elements that the biasing member contacts the printing component upon fixing the printing component in the mounting elements.

19. A method of installing a printing component within a printer, the steps comprising:

providing an elongate printing component;

providing a printer housing with a retention feature having at least two mounting elements;

inserting a first end of the printing component in a first mounting element such that the first end is restrained in at least a first direction by the first mounting element; and, inserting the second end of the printing component is a second mounting element such that the second end of the printing component is restrained in at least the first direction by the second mounting element.

20. A method according to claim 19, wherein the printing component comprises a printline, wherein said printline projects in said first direction.

21. A method according to claim 19, wherein at least one of the mounting elements comprises a planar surface having at least one ridge projecting therefrom, and the step of inserting that mounting element comprises abutting an end of the printing component against a ridge of the respective mounting elements.

22. A method according to claim 19, further comprising the step of providing a bias upon a biasing member with the printing component upon installation of the printing component.

23. A method according to claim 19, wherein at least one mounting element comprises a deflectable tab, further comprising the step of deflecting the tab after installation of the printing component to thereby release the printing component from the tabbed mounting element.

24. A thermal printer comprising:

a printer body having on opposed sides of a media path through the printer a printhead component retention feature; and an elongated thermal printhead component having a linear row of separately energizable heating elements, the printhead component and component retention feature being mutually configured such that the printhead component is readily installed in said retention feature by a simple push-lock action.

25. A printer of claim 24, wherein said printhead retention feature comprises on at least one side of the media path a retention region for an end of the printhead component.

26. A printer of claim 24, wherein the printer body is molded and wherein said component retention feature comprises on at least one side of the media path a retention region for one end of the printhead component which is molded integrally into the printer body.

27. A printer of claim 26, wherein said retention feature includes a release feature for releasably retaining said end of said printhead component.

28. A printer of claim 27, wherein said release feature comprises a deflectable push-lock feature molded integrally into said printer body.

29. A printer of claim 24, wherein at least one end of said printhead component has an adaptor structured to mate with said retention feature.

30. A printer of claim 24, wherein the printer body is a clamshell printer body having a lower housing section mounting a platen and hinged thereto an upper housing section including on opposed sides of the media path through the printer the printhead component retention feature.

* * * * *